United States Patent [19]

Weller et al.

[11] 4,031,280

[45] June 21, 1977

[54] METHOD AND APPARATUS FOR COLORING A PILE FABRIC, AND A PILE FABRIC PRODUCED THEREBY

[75] Inventors: John V. C. Weller; George C. Strydio; Helmuth Vits, all of Greenville, S.C.

[73] Assignee: Bigelow-Sanford, Inc., Greenville, S.C.

[22] Filed: Aug. 9, 1976

[21] Appl. No.: 712,675

[52] U.S. Cl. ..... 428/88; 8/148; 101/115; 101/151; 101/193; 101/194; 101/211; 428/96; 428/196

[51] Int. Cl.[2] ..... B41F 15/04

[58] Field of Search ..... 428/88, 96, 196; 8/148; 101/115, 151, 193, 194, 211

[56] References Cited

UNITED STATES PATENTS

| | | | |
|---|---|---|---|
| 2,816,811 | 12/1957 | Tillett | 8/148 |
| 2,984,540 | 5/1961 | Tillett | 8/148 |
| 3,175,488 | 3/1965 | Tillett | 8/148 |

*Primary Examiner*—Marion E. McCamish
*Attorney, Agent, or Firm*—Burgess Ryan and Wayne

[57] ABSTRACT

In a process and apparatus for coloring a pile fabric, liquid coloring material is introduced into compartments, and the pile fabric is pressed face downwardly into the compartments. In order to provide regions wherein different colors are distinct from one another, a resilient barrier is provided between compartments to which different colored liquid coloring material is introduced and in order to provide areas of the pile fabric wherein the colors are blended, liquid coloring material of different colors is introduced into the compartments in regions not separated by a resilient barrier.

6 Claims, 8 Drawing Figures

METHOD AND APPARATUS FOR COLORING A PILE FABRIC, AND A PILE FABRIC PRODUCED THEREBY

This invention relates to a method and apparatus for coloring pile fabrics, such as pile carpeting, and a pile fabric produced thereby, and is more specifically directed to a process and apparatus wherein the coloring material extends deeply into the pile fabric, for example, up to the fabric backing.

Processes and apparatus for the deep dyeing of pile material are well known, and are disclosed, for example, in U.S. Pat. No. 2,984,540, Tillet et al, and U.S. Pat. No. 3,175,488, Tillet et al. In accordance with the disclosures of these patents liquid coloring material is introduced into adjacent receptacles or compartments separated by resilient barriers, and a pile fabric, such as a carpet, to be printed or dyed, is compressed face downwardly into the compartments. As a result, the liquid material impregnates the fibers of the fabric to an extent determined, for example, by the amount of coloring material in the compartments.

In the disclosures of the above Tillett et al patents, only liquid coloring material of one color is introduced into each of the compartments, whereby the boundary between different colored regions on the resilient pile fabric is distinct.

In the art of dyeing pile fabrics, such as pile carpeting, it has been previously considered necessary to separate the regions of the dyeing apparatus into which liquid coloring material of different colors was introduced. Thus, as discussed in U.S. Pat. No. 2,816,811, Tillett et al, it is indicated that, unless barriers are provided between the compartments in dyeing techniques of this type, the dyes will spread sideways so that the adjacent colors interpenetrate, to provide disastrous effects. Thus, in accordance with this latter patent, it was considered that indistinct boundaries between regions on different colors would result in the production of a pile fabric that did not appear to be a quality product.

In the process of U.S. Pat. No. 2,816,811, the pile fabric is pressed into the resilient walls between the compartments, in order to enable the separation of color regions, but the fabric was not compressed in the compartments, additional liquid coloring material being added to the compartments as necessary during the dyeing process. In the process of U.S. Pat. Nos. 2,984,540 and 3,175,488, however, all of the liquid coloring material to be employed was introduced into the compartments prior to immersion of the pile fabric therein, and the pile fabric was compressed into the compartments. It was considered, however, that the disadvantages discussed in U.S. Pat. No.2,816,811, with respect to the interpenetrating of colors, were also applicable to the process disclosed in U.S. Pat. Nos. 2,984,540 and 3,175,488.

It has now been found, however, that, contrary to the disclosure of U.S. Pat. No. 2,816,811, an ornamental and pleasing appearance may be produced in a pile fabric produced in accordance with the disclosures of U.S. Pat. Nos. 2,984,540 and 3,175,488, by introducing liquid coloring materials of different colors into regions of the dyeing apparatus which are not separated by resilient barriers.

Thus, briefly stated, in accordance with the present invention, a method and apparatus are provided for printing or dyeing, preferably deep dyeing, a pile fabric material such as pile carpeting, wherein liquid coloring material is introduced into compartments of the dyeing apparatus, and the pile fabric to be dyed is compressed into the compartments. Liquid coloring material of different colors is introduced into the dyeing apparatus in at least some regions where no resilient barrier if provided between the compartments, so that, prior to the compressing of the pile fabric therein, the liquid coloring material may intermix. As a result, in a pile fabric produced in accordance with the invention, in at least some of the regions of the fabric the fabric has a wide variety of different colors resulting from the blending of the liquid coloring material of different colors.

In accordance with a further advantageous embodiment of the invention, during the dyeing process some areas at which different colored liquid coloring material is introduced are separated in barriers, and other areas at which different color liquid coloring material are introduced are not separated by resilient barriers, whereby the resultant product has some areas with distinct boundaries defining color transitions and some areas with blended transitions.

In order that the invention be more clearly understood, it will now be disclosed in greater detail, with reference to the accompanying drawings, wherein.

Figure 1:
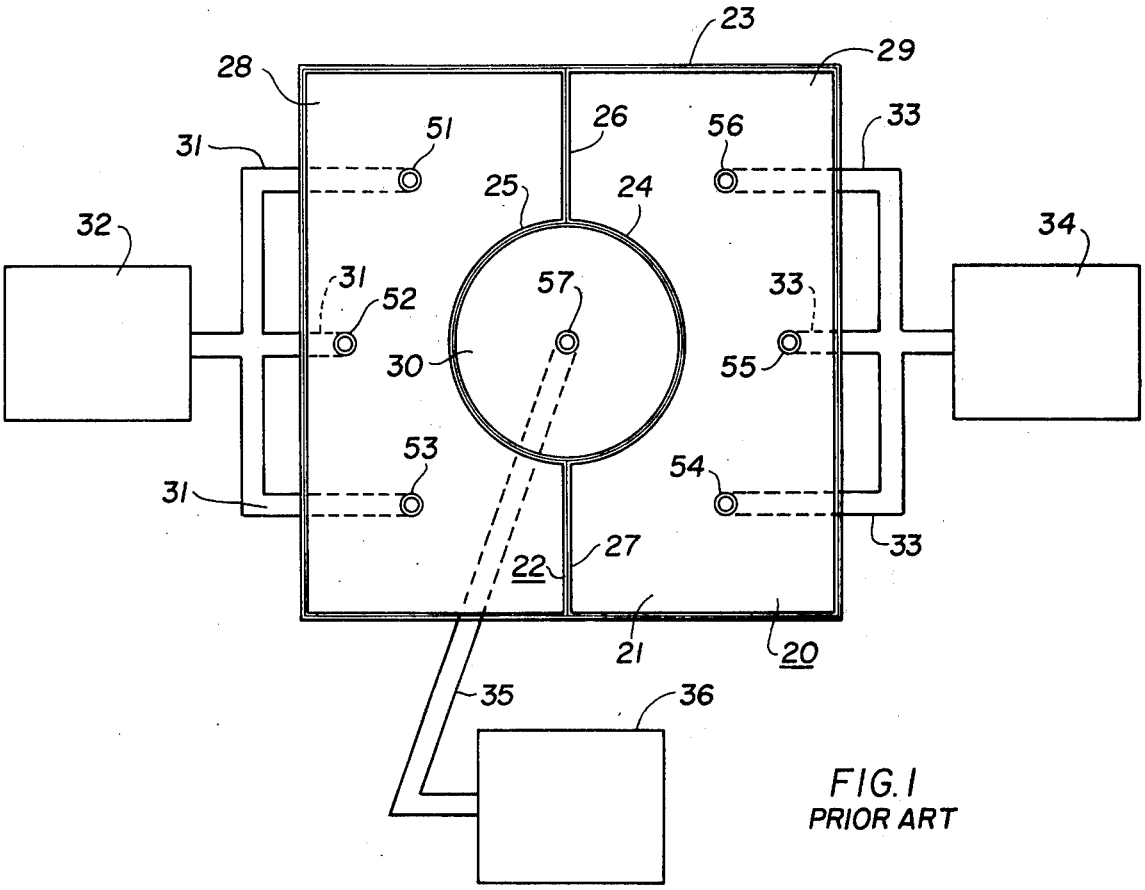
FIG. 1 PRIOR ART
FIG. 1 is a simplified top view of a portion of a known dyeing apparatus.
Figure 2:
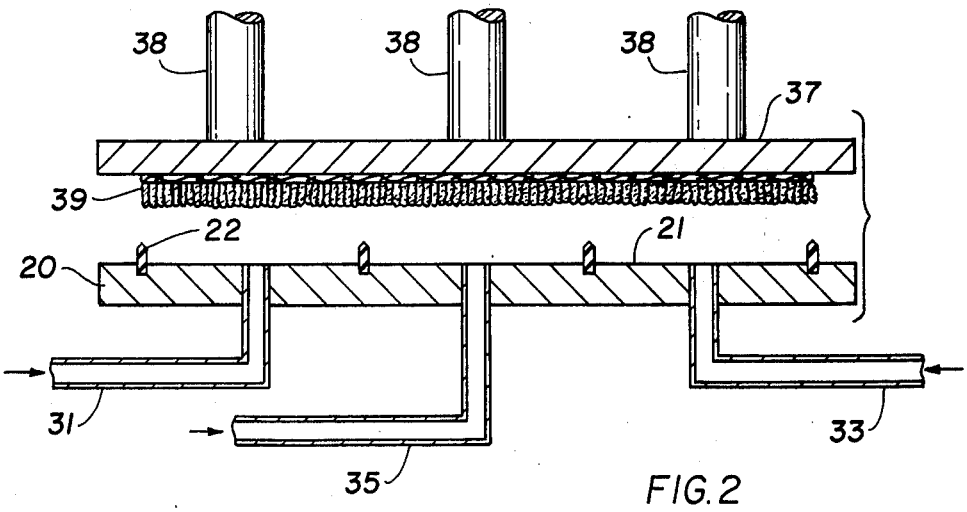
FIG. 2 PRIOR ART
FIG. 2 is a partially cross sectional view of a portion of the apparatus of FIG. 1, further showing the platen and pile fabric to be dyed.

FIGS. 1 and 2 illustrate, in simplified form, known apparatus for printing and dyeing of pile material, which, as will be discussed in the following paragraphs, can readily be modified in accordance with the present invention. The apparatus illustrated in FIGS. 1 and 2 is generally of the type disclosed in U.S. Pat. No. 2,984,540, Tillett et al, and it will be apparent that the apparatus and process disclosed in this patent may be modified in accordance with the teachings of the present invention.

The apparatus is comprised of a tray of receptacle 20, the upper surface 21 of which is separated into a plurality of compartments by upstanding walls 22, preferably formed of resilient strips, for example of rubber, plastic or other compressible materials. In the arrangement illustrated in FIG. 1, a wall 23 is provided extending completely around the periphery of the receptacle 20, a circular wall having a right half portion 24 and a left hand portion 25 is provided generally centrally in the receptacle, a wall 26 extends from the circular wall to one side of the outer wall 23, and a wall 27 extends from the circular wall to the opposite outer wall. The resilient walls thereby separate the upper surface of the receptacle 20 into a compartment 28 to the left of the circular wall, a compartment 29 to the right of the circular wall, and a compartment 30 within the circular wall. This configuration of walls separating the receptacle into compartments has been arbitrarily selected in order to more clearly explain the features of the present invention, and it will of course be obvious that other configurations of walls may be employed.

Preferably at least one hole is provided extending through the receptacle 20 in each of the compartments, and the holes of each compartment are connected to a common source of liquid coloring material. Thus, FIG. 1 illustrates three ducts 31 extending to the compartment 28, and connected to a source 32 of coloring material. The compartment 29 is connected by way of ducts 33 to a source 34 of the liquid coloring material, which may be of a different color than that of the liquid coloring material of source 32. Similarly, a duct 35 is connected from the compartment 30 to a further source 36 of the liquid coloring material, which may be of a color different from that of the liquid material of the sources 32 and 34.

As illustrated in FIG. 2, the apparatus is further comprised of a top platen 37 aligned above the receptacle 20, and adapted to hold a pile fabric 39 to be dyed on its lower surface. For example, as discussed in U.S. Pat. No. 2,984,540, a vacuum chamber may be provided within the platen 37 for holding the pile fabric in place. The top platen 37 is adapted to be vertically moved, for example by means of rods 38 affixed to the top thereof, so that the platen, with the pile fabric on its lower surface, can be forced against the receptacle 20, with the resilient walls of thereceptacle being forced into the pile of the pile fabric.

In operation of the apparatus illustrated in FIGS. 1 and 2, a determined amount of liquid coloring material of conventional nature is fed from the sources 32, 34 and 36 to the respective compartments, by way of the interconnecting tubes. The platen 37, with the pile fabric on its lower face, is then forced downwardly, so that the pile fabric is compressed in the compartments and the liquid coloring material therein impregnates the pile fabric. As a consequence, the fabric will be colored with distinct boundaries between the colored regions corresponding to the positions of the resilient wall on the receptacle.

It will of course be apparent that the number of tubes provided for feeding the liquid coloring material to each of thecompartments is determined by the size of the respective compartments as well as the characteristics of the liquid coloring material and the type of pumping or metering device employed for directing the liquid coloring material to the compartments. In the arrangement of the present invention, to be discussed in the following paragraphs, conventional pumps or metering devices, as discussed in U.S. Pat. No. 2,984,540 may be employed.

The apparatus as disclosed in FIGS. 1 and 2 intentionally surrounds each compartment corresponding to a separate color by a continuous resilient wall, in order to prevent sidewise spreading of the liquid coloring material and to provide distinct boundaries between the different colored regions. Thus, it was previously considered necessary, for example, as expressed in U.S. Pat. No. 2,816,811, Tillett et el, to provide such distinct boundaries since undesirable results were previously obtained in different deep dyeing techniques, due to intermixing of colors in boundary regions.

Figure 3:
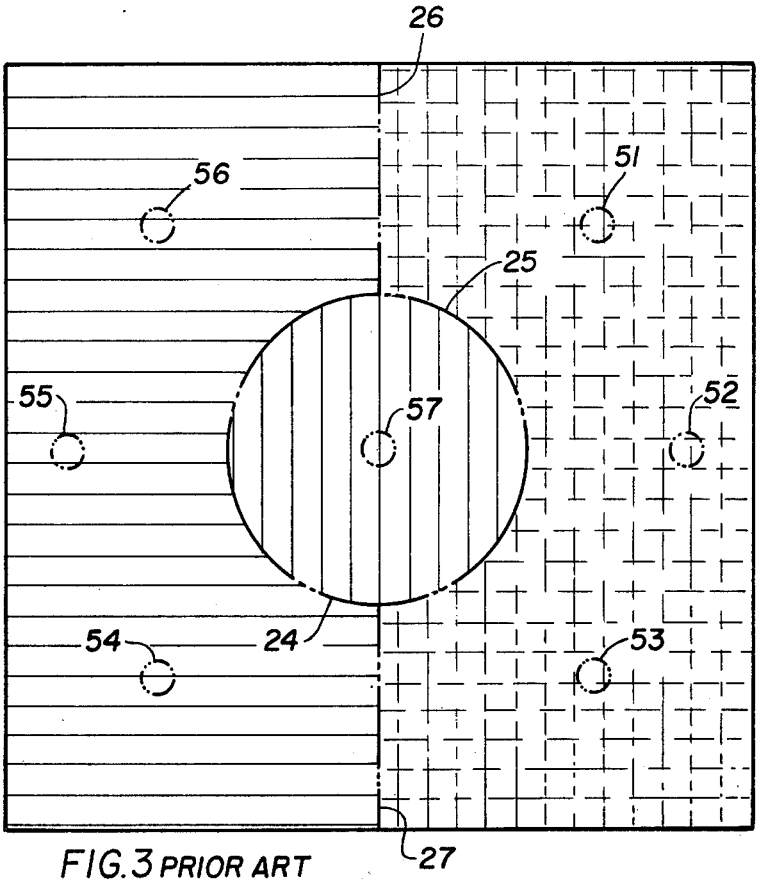
FIG.3 PRIOR ART
FIG. 3 is an enlarged plan view of a pile fabric dyed with the apparatus of FIGS. 1 and 2.

In one example, it is assumed that the holes 51, 52 and 53 in the compartment 28 are connected by the tubes 31 to the source of coloring liquid 32 having yellow coloring material, the holes or ports 54, 55 and 56 in the compartment 29 are connected by way of tubes 33 through the source 34 having blue coloring material, and the port 57 in the central compartment 30 is connected by way of the tube 35 to the source 36 having a red coloring material, then the fabric dyed with the apparatus will have the appearance illustrated in FIG. 3, wherein the threecolor rigions are distinct separate from one another. It will be noted that the colors on the fabric as illustrated in FIG. 3 are reversed from the assumed liquid color materials in the apparatus of FIG. 1, since FIG. 3 depicts the dyed face of the fabric after it has been removed from the apparatus. For the sake of clarity, FIG. 3 illustrates the positions of the ports of the receptacle, as well as the positions of the interior resilient walls.

In accordance with the invention, it has now been found that an apparatus of the type illustrated in FIGS. 1 and 2 may be modified to remove the resilient walls or barriers between areas of the receptacle containing different coloring material, and that a pile fabric colored with such an apparatus will have a pleasing and ornamental appearance even though or perhaps because of the face that, the colors of the adjacent regions thereby intermix.

Figure 5:
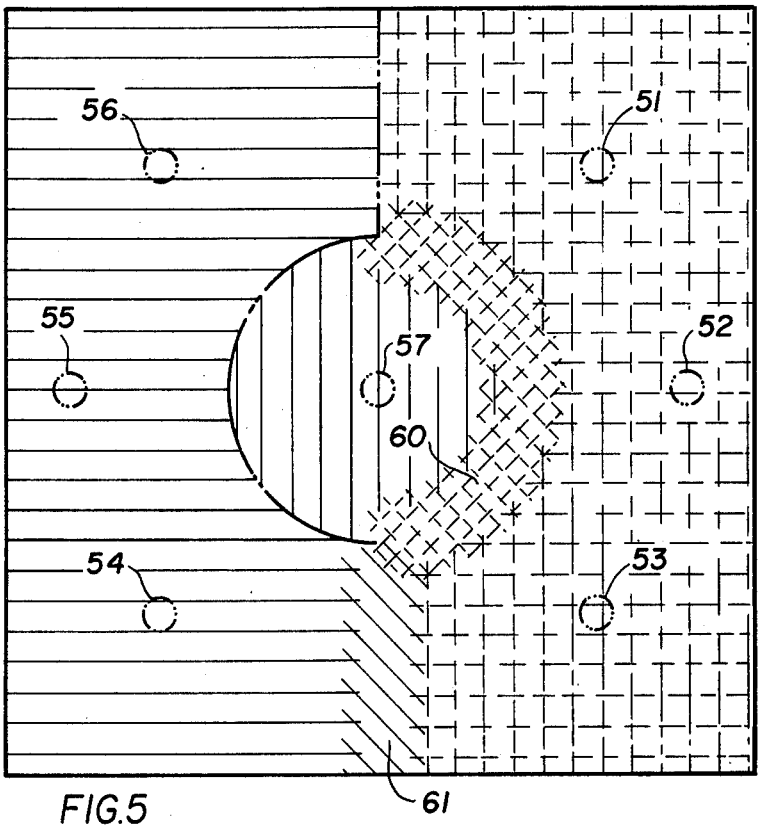
FIG. 5 is an enlarged plan view of a pile fabric dyed with the apparatus of FIG. 4.
Figure 4:
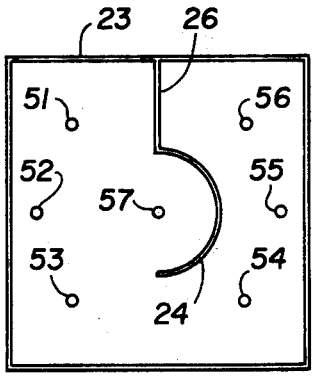
FIG. 4 illustrates in diminished form a modification of a portion of the apparatus of FIG. 1, in accordance with the invention.

For example, as illustrated in FIG. 4, the apparatus of FIG. 1 is modified to omit the left half 25 of the circular wall, as well as to omit lower wall 27 between the circular barrier and the outer wall. Assuming the introduction of liquid coloring material into the compartments as above discussed with reference to FIG. 1, a pile fabric produced with the modified apparatus of FIG. 4 is illustrated in FIG. 5. Thus, in an area 60, generally in the region where the wall 25 was omitted, the yellow coloring material introduced by way of ports 51–53 intermixes and blends with the red coloring material introduced by way of port 57. As a consequence, the area 60 will be colored in varying degrees of the combination of red and yellow, i.e, in varying shades of orange, to produce a pleasing and ornamental appearance. Similarly, in the rigion 61 where the wall 27 was omitted, the yellow coloring material introduced by way of port 53 intermixes and blends with the blue coloring material introduced by way of port 54, so that varying shades of green appear in the region 61.

Figure 7:
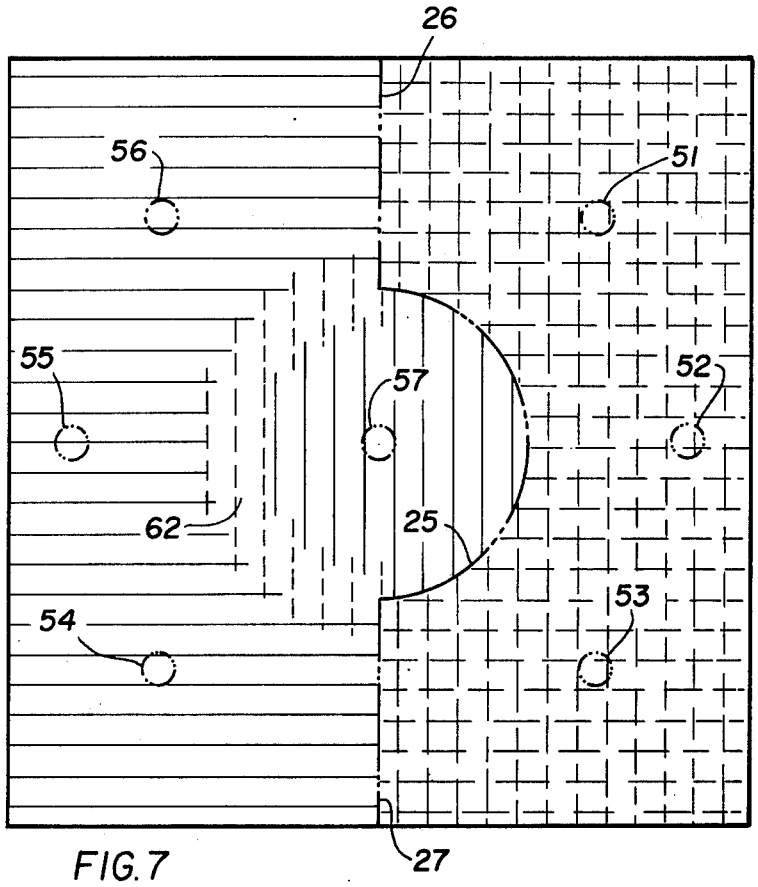
FIG. 7 is an enlarged plan view of a pile fabric dyed with the apparatus of FIG. 6.
Figure 6:
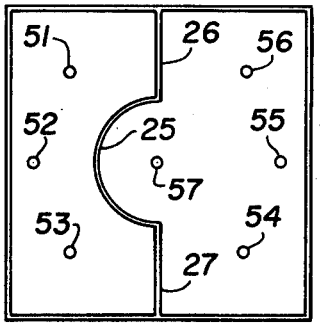
FIG. 6 illustrates in diminished form another modification of the apparatus of FIG. 1 in accordance with the present invention.

In a further example, as illustrated in FIG. 6, the right half 24 of the circular barrier has been omitted, as compared with the arrangement of FIG. 1. Assuming the same liquid coloring materials are employed as in the above examples, the resultant coloration of a pile fabric produced by the apparatus of FIG. 6 will be as illustrated in FIG. 7. This figure illustrates a region 62, in the vicinity of the omitted wall 24, wherein the blue coloring material introduced by way of ports 54–56 intermixes and blends with the red coloring material introduced by way of port 57, to produce a multitude of shades of purple or violet in the region 62.

In a still further embodiment of the invention, a receptacle of the type illustrated in FIG. 1 is employed, i.e., the resilient walls are not modified. In this modification, however, the port 53, instead of being connected to a source of yellow coloring material, is connected to a source of blue coloring material. As a consequence, as illustrated in FIG. 8, the area 63 immediately surrounding the port 53 will be colored blue, and this area will be encircled by a region 64 in which the yellow and blue coloring material intermixes to result in a multitude of shades of green.

Figure 8:
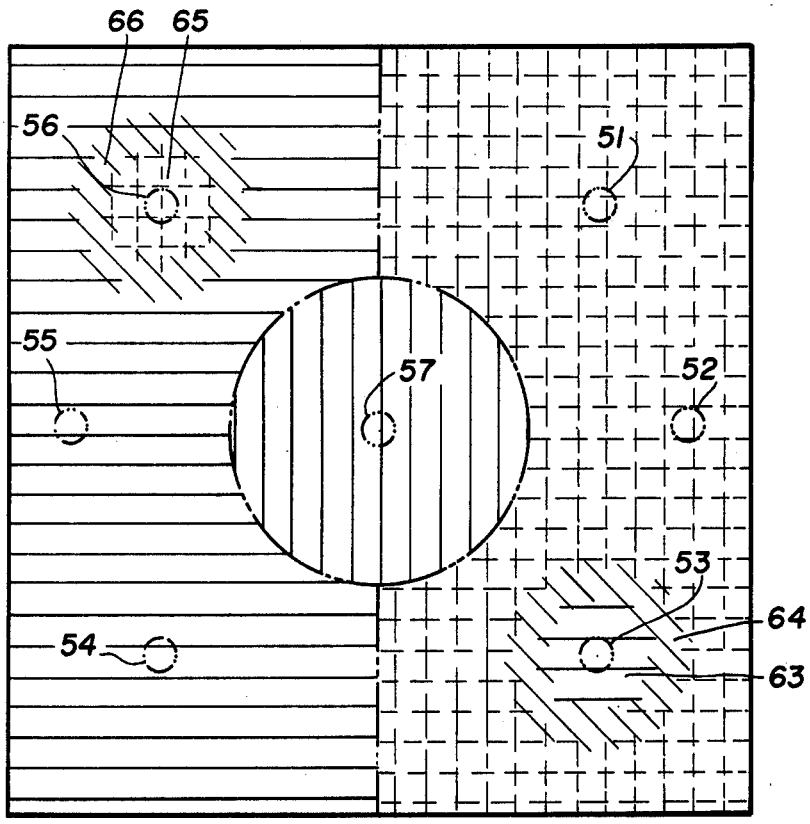
FIG. 8 is an enlarged plan view of a pile fabric dyed in accordance with the present invention, with the apparatus of FIG. 1.

Similarly, if the port 56 of FIG. 1 is alternatively connected to a source of yellow coloring material, the resultant pile fabric will appear as illustrated in FIG. 8, with a yellow circular region 65 in the region of the port 56, surrounded by a region 66 of a multitude of shades of green.

In the processing in accordance with the present invention, it is preferred that the pile fabric, such as a pile carpeting material, be compressed in the receptacle, during the coloring of the pile fabric, as disclosed in U.S. Pat. No. 2,984,540.

In the process in accordance with the invention, any conventional liquid coloring materials or dyes may be employed, as long as they are capable of intermixing in the region where they meet in the receptacle. The coloring materials of different colors may be introduced into receptacle simultaneously, or they may be introduced sequentially, in order to control the region where the intermixing and blending of colors occurs. The process produces a definite change in the patterning of the pile fabric, as compared to the process wherein all of the walls are continuous. Further, it has been found that, with the process in accordance with the invention, the contours are very graduated and soft. It should be noted that the apparatus employed in the process in accordance with the invention should be of the type illustrated in the above U.S. Pat. No. 2,984,540, wherein the liquid coloring materials are introduced into the receptable prior to the compression of the pile fabric into the receptacle, in order that the liquid coloring materials mix and blend with one another in the desired region before the coloring of the pile fabric. Further, as in the arrangement of U.S. Pat. No. 2,984,540 the number of ports provided in the receptacle, and the relative spacings of the ports, is not critical and is determined by the desired shape and form of the regions in which the color is to be blended.

While the invention has been disclosed with reference to a limited number of embodiments, it will be apparent that variations and modifications may be made therein, and it is therefore intended in the following claims to cover each such variation and modification as falls within the true spirit and scope of the claims.

What is claimed is:

1. In a process for the application of color designs to pile fabrics including introducing determined amounts of liquid color materials, at spaced apart points, into a receptacle having at least one resilient barrier for defining color transistions and positioned between a pair of said points, and then pressing the pile face of the pile fabric into the receptacle, whereby the color materials in the receptacle impregnate the pile fabric to provide a color design in the pile fabric; the improvement wherein said step of introducing color materials into said receptacle comprises introducing first and second liquid color materials of different color into said receptacle at first and second adjacent points respectively between which said flow of liquid materials is not inhibited by said resilient barrier, whereby said first and second liquid materials intermix in a region between said first and second points to color the portion of said pile fabric pressed into said region with a color that is a blend of the colors of said first and second liquid materials.

2. The process of claim 1 wherein a given area of said receptacle is defined by a single barrier, said step of introducing comprising introducing said first and second liquid coloring materials at spaced apart points in given area.

3. The process of claim 1 wherein first and second adjacent areas of said receptacle are partially defined by a barrier between them, said barrier being interrupted at one common boundary region between said areas, wherein said step of introducing comprises introducing said first liquid coloring material into said first area and introducing said second liquid coloring material into said second area, whereby said first and second liquid coloring materials intermix and blend in the region of said common boundary.

4. The process of claim 1 wherein said step of introducing comprises additionally introducing liquid coloring materials of different color to adjacent areas of said receptacle which are separated by said resilient barrier.

5. A multi-colored pile fabric having on its pile face first and second adjacent colored regions of different color that are sharply defined at the boundary therebetween, and third and fourth adjacent regions of different color, the colors of said third and fourth regions being intermixed and blended in a multitude of shades of blending of the colors of said third and fourth regions and between said third and fourth regions.

6. In an apparatus for coloring the pile face of a pile fabric, wherein a receptacle is provided having upstanding resilient walls for containing liquid coloring material in a determined manner, means for introducing liquid coloring material of different colors to said receptacle, and means for pressing the pile face of a pile fabric into said receptacle to be colored by liquid coloring material therein; the improvement wherein a given area of said receptacle, defined at its periphery by a continuous wall, comprises a plurality of spaced apart ports for introducing liquid coloring material into said receptacle, means for introducing liquid coloring material of a first color into at least one of said ports, and means for introducing liquid coloring material of a different color to another of said ports, whereby said liquid coloring material may intermix in said area in the region between said one and other ports.

* * * * *

UNITED STATES PATENT OFFICE

CERTIFICATE OF CORRECTION

Patent No. 4,031,280 Dated June 21, 1977

Inventor(s) John V. C. Weller, et al

It is certified that error appears in the above-identified patent and that said Letters Patent are hereby corrected as shown below:

Column 6, line 16: After "in" insert --said--.

Signed and Sealed this

*Eighth* Day of *November 1977*

[SEAL]

*Attest:*

RUTH C. MASON
*Attesting Officer*

LUTRELLE F. PARKER
*Acting Commissioner of Patents and Trademarks*